US006379289B1

(12) United States Patent
Gossie

(10) Patent No.: US 6,379,289 B1
(45) Date of Patent: Apr. 30, 2002

(54) MID-SECTION EXERCISE APPARATUS WITH MULTI-AXIS CAPABILITIES

(76) Inventor: Albert M. Gossie, 80 Lake St., Hammondsport, NY (US) 14840

( * ) Notice: Subject to any disclaimer, the term of this patent is extended or adjusted under 35 U.S.C. 154(b) by 0 days.

(21) Appl. No.: 09/370,741

(22) Filed: Aug. 9, 1999

Related U.S. Application Data

(60) Provisional application No. 60/095,957, filed on Aug. 10, 1998.

(51) Int. Cl.[7] ..... A63B 26/00

(52) U.S. Cl. ..... 482/142; 482/138

(58) Field of Search ..... 482/130, 142, 482/129, 143, 144, 146, 138, 72, 147–148; 672/118, 127, 130; 297/115–117, 411.35

(56) References Cited

U.S. PATENT DOCUMENTS 4,563,000 A * 1/1986 Gall ..... 272/72
4,696,514 A * 9/1987 Maloney ..... 297/284
4,836,532 A * 6/1989 Kuo ..... 272/72
5,094,449 A * 3/1992 Stearns ..... 482/130
5,098,040 A * 3/1992 Retat ..... 244/158
5,143,422 A * 9/1992 Althofer ..... 297/411
5,273,509 A * 12/1993 Vittone ..... 482/139
5,487,714 A * 1/1996 Ferrari ..... 482/123
5,547,444 A * 8/1996 Huang ..... 482/72
5,582,563 A * 12/1996 Fan ..... 482/96
5,624,361 A * 4/1997 Lai ..... 482/130
5,722,917 A * 3/1998 Olschansky et al. ..... 482/72
5,730,688 A * 3/1998 Prusick ..... 482/130
5,769,766 A * 6/1998 Huang ..... 482/140
5,803,876 A * 9/1998 Hickman ..... 482/72
5,967,610 A * 10/1999 Lin ..... 297/340
5,997,450 A * 12/1999 Wilkinson ..... 482/142
6,022,303 A * 2/2000 Abdo ..... 482/140
6,113,522 A * 9/2000 Fontenot et al. ..... 482/111

* cited by examiner

*Primary Examiner*—Justine R. Yu
(74) *Attorney, Agent, or Firm*—Brian B. Shaw, Esq.; Stephen B. Salai, Esq.; Harter, Secrest & Emery LLP

(57) ABSTRACT

An exercise apparatus for permitting multi-axis rotation of the body. The apparatus includes a seat attached to a frame and a pair of arm rests connected to the frame for motion relative to the seat and frame, and more particularly, for rotational movement relative to the seat about a first and a second axis.

20 Claims, 4 Drawing Sheets

MID-SECTION EXERCISE APPARATUS WITH MULTI-AXIS CAPABILITIES

This application claim benefit to provisional application No. 60/095,957 filed Aug. 10, 1998.

FIELD OF THE INVENTION

The present invention relates to exercise devices, and more particularly to a resistance training device that provides universal motion of the operator's mid-section.

BACKGROUND OF THE INVENTION

Various prior exercise machines provide for resistance training of either the back or the front abdomen muscles. In some machines, it is possible to first exercise the front abdomen muscles, and then exercise the back muscles by a user changing his orientation on the machine. For example, the machine may include separate stations for exercising the back and the front abdominal muscles, where a user moves between stations for the various exercises. As another example, the user may need to reverse his position with respect to the machine for the series of exercises. In other machines, the apparatus must be physically rearranged when switching from back to front abdominal exercises. In such cases, it is inconvenient to switch between the front and back exercises, and such apparatus do not provide for a universal motion that permits exercise of the back, the front abdomen and both sides of the torso.

SUMMARY OF THE INVENTION

This invention provides an exercise apparatus that comprises: a stationary frame; a seat connected to the frame; and a pair of arm rests pivotally connected to the frame for a motion about a first axis and a motion about a second axis with respect to the frame. Preferably, the second axis is substantially perpendicular to the first axis.

According to various preferred embodiments, the arm rests are connected to one another through an arm rest bracket, and the arm rest bracket is arcuately shaped and extends between the arm rests and below the seat. The seat may remain stationary with respect to the frame during the motion of the arm rests, and the seat may be adjustable to a variety of positions relative to the frame. A back rest may be disposed above the seat, such as mounted to a rear bracket extending between the arm rests, whereby the back rest pivots in conjunction with the arm rests with respect to the frame.

Motion of the arm rests is resisted, for example, through a spring connecting the frame and a substantially universal joint on the arm rest assembly and aligned with the first and second axes. According to preferred embodiment, the resistance may be adjusted on the apparatus, so that the apparatus allows both extended exercise periods of low resistance, low impact muscular toning and fat-burning capabilities, or a higher resistance muscle-building program.

This invention allows the back, front abdomen and both sides of the torso to be exercised without changing machines, or without a user having to change his orientation on the machine. The apparatus provides universal and multi-axis motion, mid-section exercise capability within the same workout period, without the user physically moving to separate machines or work stations, and without interrupting the workout to change over the apparatus. This increases the efficiency of the exercise period since exercise programs can be immediately changed, and decreases fatigue and boredom created by the repetition of the same motions on a singular axis machine.

BRIEF DESCRIPTION OF THE DRAWINGS

FIG. 6 is a partial cross-sectional view of the cradle assembly.

DETAILED DESCRIPTION OF THE PREFERRED EMBODIMENTS

Figure 2:
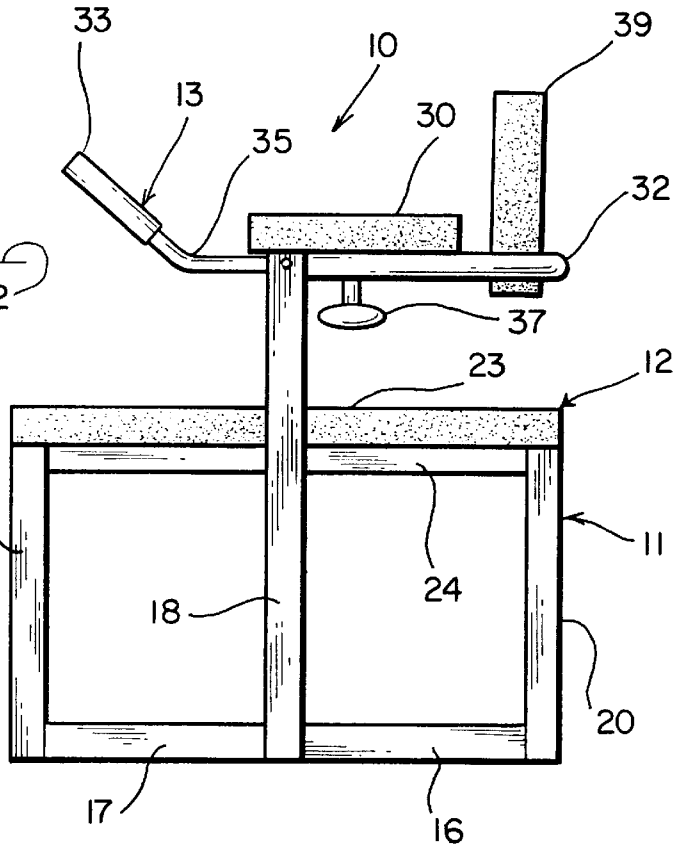
FIG. 2 is a left side elevational view of the exercise apparatus of FIG. 1.

FIGS. 1–7 illustrate an exercise apparatus according to various preferred embodiments of this invention.

Exercise apparatus 10 generally includes a frame 11, a seat 12, and an arm rest assembly 13.

The frame 11 is a rigid, self supporting structure having a sufficient footprint which substantially precludes unintended movement. In the illustrated embodiment, the frame includes a transverse bottom bar 15, and two bottom bars 16, 17 perpendicular thereto, which are fixedly attached to bar 15, for example, with welds and/or fasteners. Two uprights members 18, 19 extend from ends of bar 15, and two upright members 20, 21 extend from ends of bars 16, 17. These components are preferably constructed of a rigid material with sufficient strength to support the entire apparatus, a representative material being tubular metal posts.

In the illustrated embodiment, uprights 20, 21 serve to support seat 12, the seat including a cushion 23 supported on a rigid support 24, with this seat support fixedly attached to ends of the uprights 20, 21. Thus, the seat is relatively stationary with respect to the frame, i.e., the seat does not pivot in conjunction with the armrest assembly. According to preferred embodiments, however, the seat is adjustable to a variety of positions. For example, the uprights 20, 21 may be constructed of telescoping members, the telescoping members including corresponding sets of holes for receiving a pin therethrough, such that the height of the seat is easily adjustable by an operator. The provision of the adjustable seat height facilitates that a variety of users may employ the apparatus, as during operation the user's feet should comfortably rest on the floor on which the apparatus is supported and the user's lower arms should comfortably rest on the arm rests 30, 31.

The arm rest assembly 13 is connected to the frame 11 to permit motion of the assembly relative to the frame about two axes. In a preferred construction, the two axes are intersecting and orthogonal, thus providing a generally universal joint.

The arm rest assembly 13 includes a pair of arm rests 30, 31. The arm rests are interconnected by a rigid, rear bracket 32. As shown in the illustrated embodiment, the arm rests may include a cushion supported on a rigid support, with these arm rest supports attached to the rear bracket 32. The ends of the rear bracket may terminate with hand grips 33, 34. Thus, during operation of the apparatus, the user's lower arms rest on the cushioned arm rests 30, 31, and the user's hands grip the hand grips 33, 34. According to preferred embodiments, the hand grips are adjustable, both inward and outward with respect to the arm rests, and also rotationally, to ensure that a user may obtain a comfortable position of the hand grips. For example, the ends of the rear bracket 32 may include telescoping members 35, 36 on which the hand grips 33, 34 are mounted. The telescoping members 35, 36 may be adjusted inward and outward, or rotated, to a desired position with respect to the main member of the rear bracket; then, the telescoping members are locked at this desired position. For example, a tightening handle 37 having a threaded end is received in a corresponding threaded opening in the telescoping members, and the handle is tightened until the end of the tightening handle contacts the main member of the rear bracket 32.

The apparatus may include a back rest 39. In the illustrated embodiment, the back rest 39 includes a cushion supported on a rigid support, with this back rest support attached to the rear bracket 32.

The arm rest assembly, including the back rest, is rotatably mounted to the frame about a first and second axis. That is, the arm rests may pivot in a generally universal motion about a point located near a mid-section of the body and the spine several inches above the seat. Preferably, the universal pivot point coincides with the user's body just below the sternum.

Figure 1:
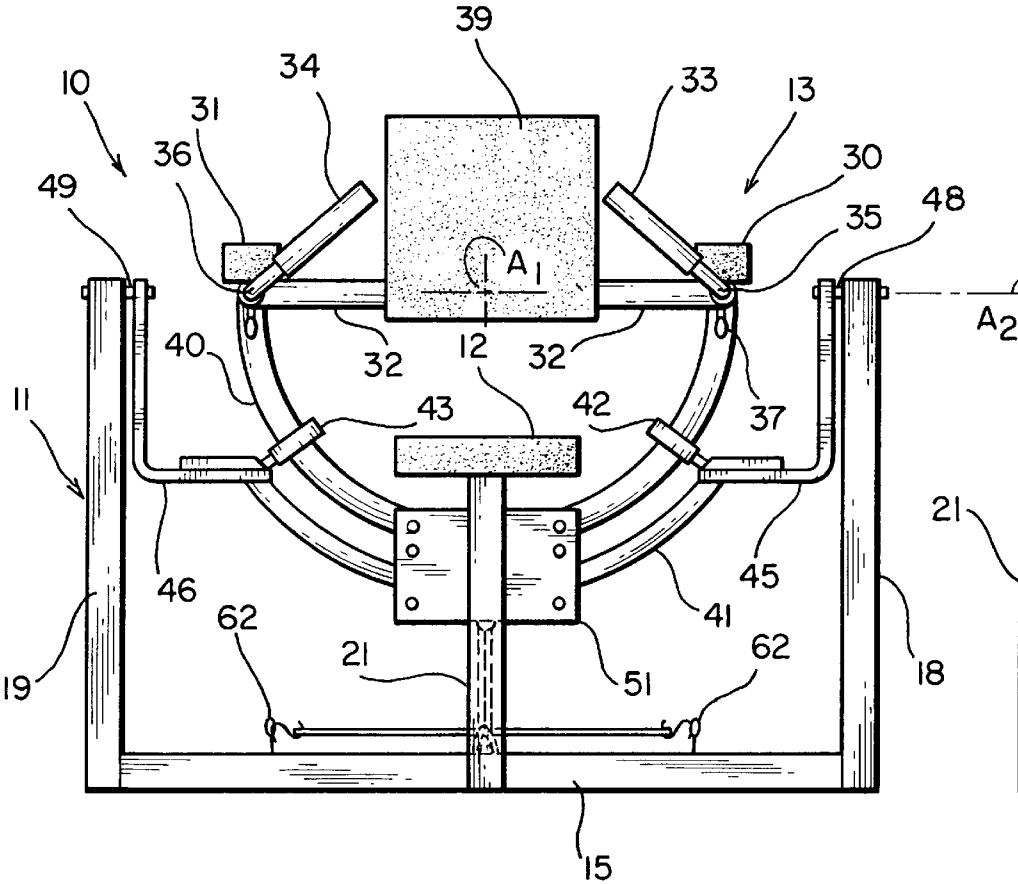
FIG. 1 is a front elevational view of the exercise apparatus according to various preferred embodiments.
Figure 3:
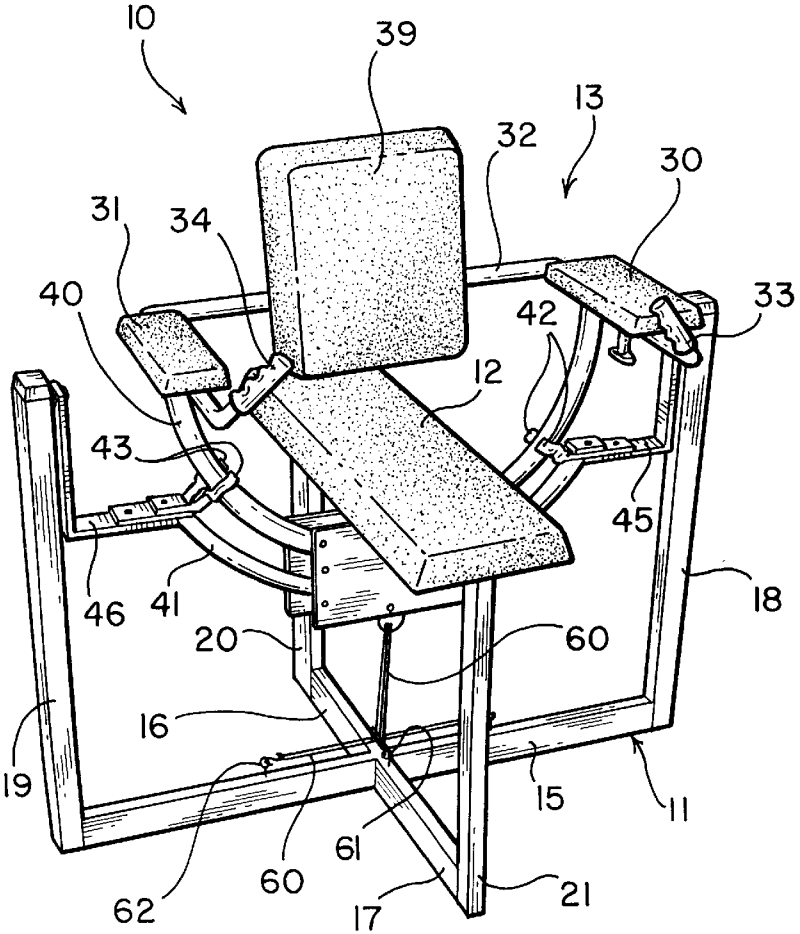
FIG. 3 is a front perspective view of the exercise apparatus of FIG. 1.
Figure 4:
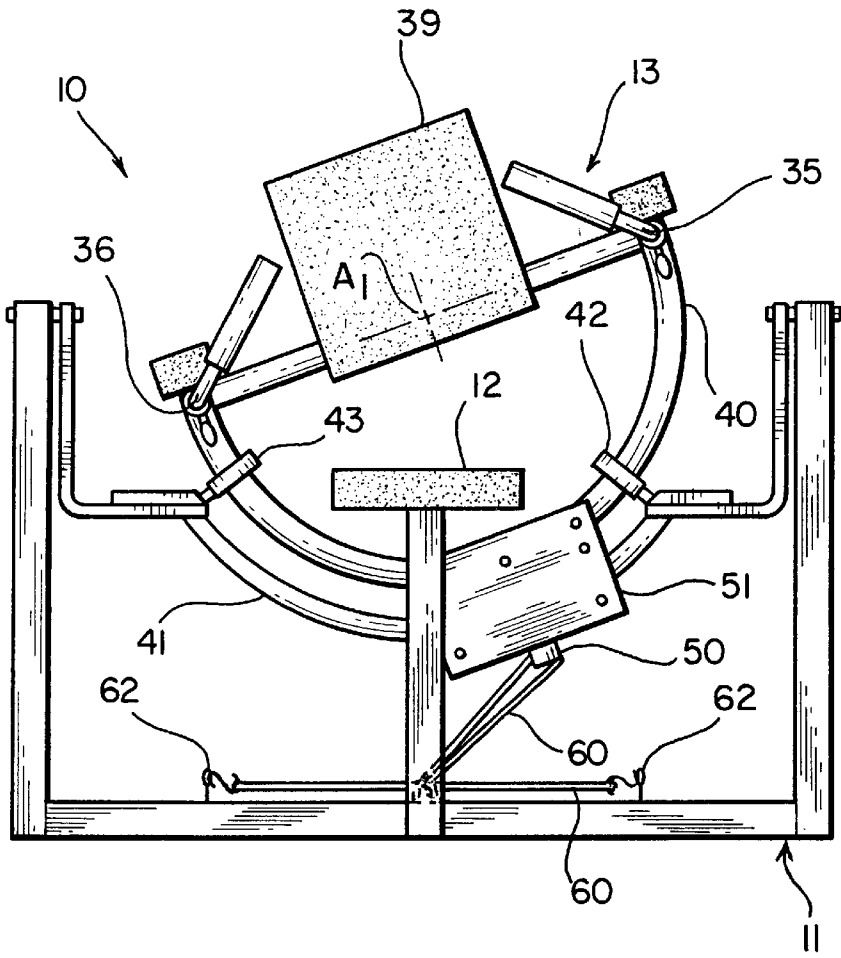
FIG. 4 is a front view of the exercise apparatus of FIG. 1, with the arm rest assembly pivoted along one axis.
Figure 7:
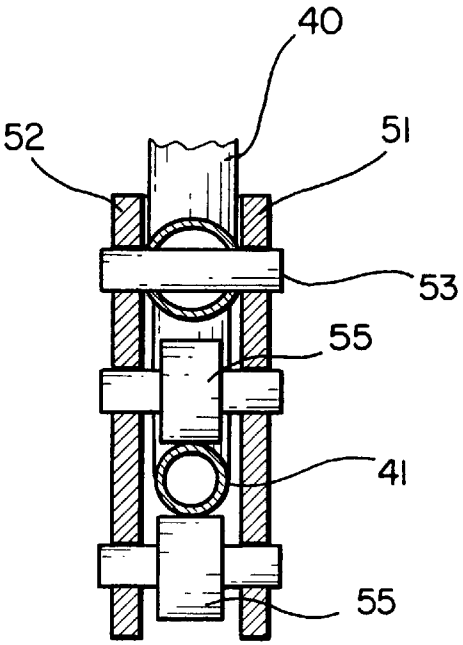
FIG. 7 is a cross-sectional view taken along line 7—7 of FIG. 6.
Figure 8:
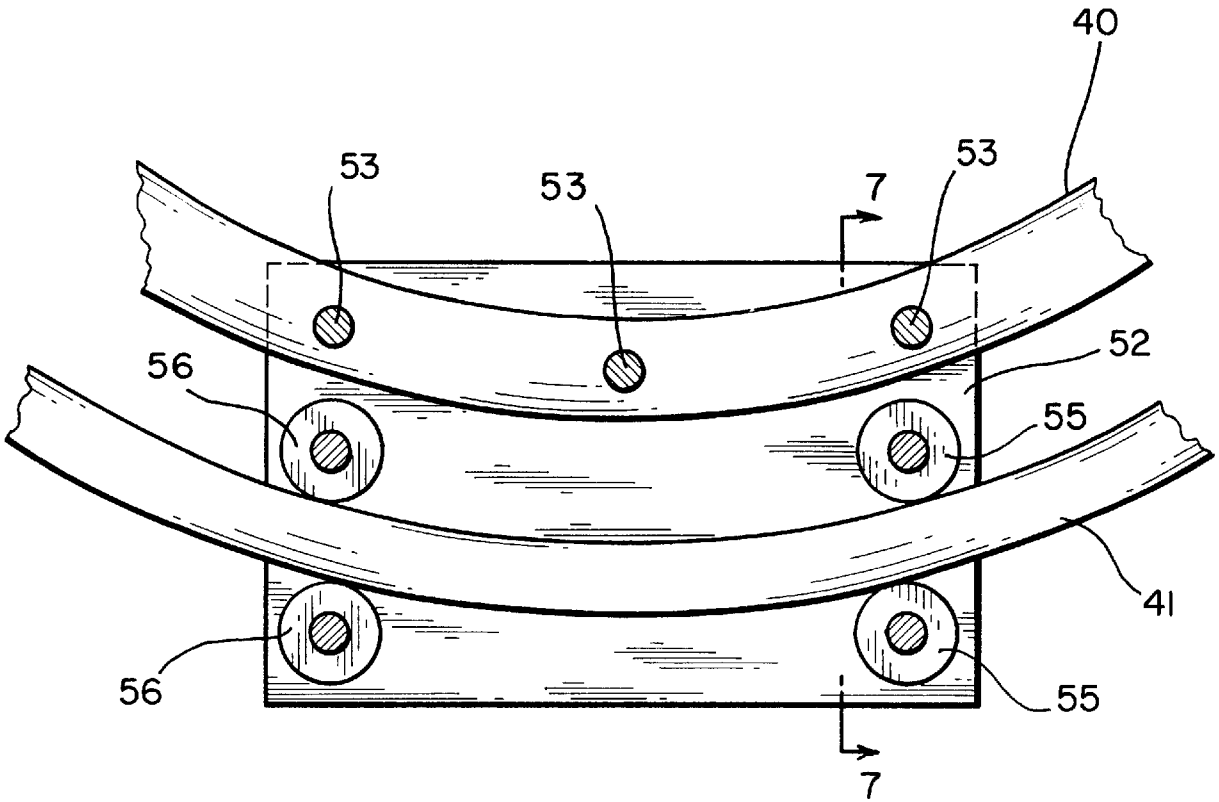

In the configuration shown in FIGS. 1–5, the arms rests 30, 31 are also connected by an arcuately shaped arm rest bracket 40 that extends between the arm rests beneath the seat. As shown in FIGS. 1, 4 and 6, this arm rest bracket 40 is in the shape of a circular arc and is moveably connected to a cradle bar 41 which in turn is pivotally connected to the frame for movement about an axis $A_2$. The arm rest bracket 40 then may be slidably disposed relative to the cradle bar 41 for rotation about an axis $A_1$. Preferably, the first axis and the second axis are generally perpendicular. In this configuration, the first and second axes of rotation may not be intersecting, but may be offset. Specifically, in the described embodiment, the axis of rotation which permits the arm rests to move relative to the cradle is vertically spaced above the axis of rotation between the cradle and the frame.

More specifically, in the illustrated configuration, arm rest bracket 40 is slidingly disposed with respect to an arcuately shaped cradle bar 41. Arm rest bracket 40 is supported within rollers 42 ,43 fixedly mounted on cradle bar 41, such that the arm rest bracket will only move with respect to the cradle bar by sliding between these rollers. Rollers 42, 43 which may be made of a plastic material such as nylon, are free to rotate about their axis; accordingly, as the arm rest bracket 40 moves with respect to the cradle bar 41, it is rolled between the rollers. Each of the arm rest bracket and the cradle bar may be constructed of circular metal tubing, and if desired, these components may be lubricated to reduce friction, for example, with a material such as petroleum jelly.

As shown in FIG. 4, when a user moves his body in a side-to-side motion, the arm rest assembly, including the back rest if present, is moved about the axis $A_1$ in a rocking motion with respect to the cradle bar and the frame. During the side-to-side motion, the cradle bar 41 remains generally stationary with respect to the frame.

In turn, the cradle bar 41 is pivotally mounted to the frame for movement about the axis $A_2$. In the illustrated configuration, each end of the cradle bar is fixedly attached to a cradle bar bracket 45, 46 and these brackets 45, 46 are pivotally connected to uprights 18, 19 at journal bearings 47, 48.

Figure 5:
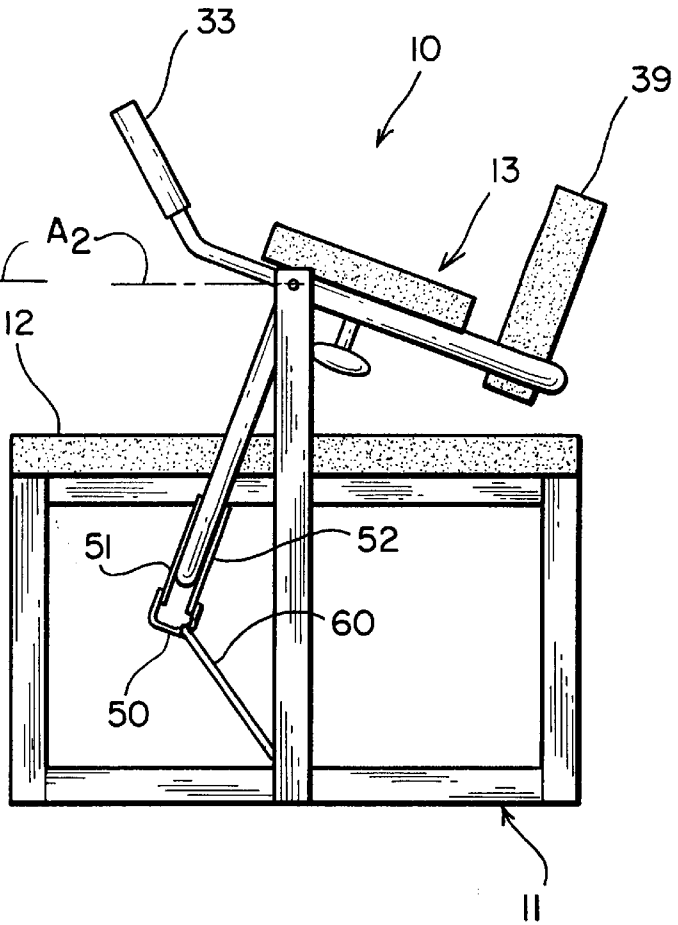
FIG. 5 is a side view of the exercise apparatus of FIG. 1, with the arm rest assembly pivoted along a second axis.

As shown in FIG. 5, when a user moves his body in a front-to-back motion, the arm rest assembly and the cradle bar are moved about the axis $A_2$ in a rocking motion with respect to the frame.

Motion of the arm rest bracket, about either the first axis or the second axis, is resisted to a desired degree. In the illustrated configuration, this is accomplished by providing a resistance tension at a generally universal joint 50. In the illustrated configuration, joint 50 is formed at two parallel metal plates 51, 52 through which both the arm rest bracket 40 and the cradle bar 41 are disposed. FIG. 6 shows a cross-section of this cradle assembly with the rear plate 52 being visible, and both plates are visible in the view of FIG. 7. The arm rest bracket 40 is fixedly attached to plates 51, 52 with fasteners 53, such as bolts, whereas the cradle bar 41 is slidingly disposed between these plates between roller sets 55, 56. Alternately, the cradle bar could be disposed between friction-resistant guides. In other words, when the arm rest bracket 40 glides between rollers sets 42, 43 during the side-to-side motion of the arm rest assembly, cradle bar 41 glides between roller sets 55, 56. Plates 51, 52 also serve to stabilize the bracket 40 and bar 41 with respect to one another during the front-to-back motion of the arm rest assembly.

The universal joint 50 is connected to the frame by a resistance tension, such as a spring. A metal spring may be used, or, as illustrated, elastic straps 60 may be used as the spring. However, it is understood that the resistance may be accomplished by a variety of structures such as hydraulic or pneumatic cylinders.

An advantage of elastic straps is that the resistance may be easily varied so that a user may select the desired degree of resistance. For example, as seen in FIG. 3, two elastic straps extend between the universal joint, are threaded through an eye-loop 61 attached to the juncture of bars 16, 17 and 15, and are attached to eye-loops 62 attached to bar 15 via S-hooks. By substituting elastic straps having greater resiliency, the resistance tension is increased. Alternately, one of the straps may be removed to reduce tension, or additional straps may be attached to the loop at joint 50 and one or more of the loops 61, 62 to increase tension.

In addition, one of the frame and the arm rest bracket may include stops for limiting the range of motion between the arm rest bracket and the frame to reduce over-extension of the user during use of the apparatus. For example, for the side-to-side motion shown in FIG. 4, movement to either side is limited by the telescoping members 35, 36 on the rear bracket 32 contacting the roller sets 42, 43, respectively as seen in FIGS. 1, 2, 4 and 5, the first axis is designated as A1 and the second axis is designated as A2.

In operation, the user positions the body facing forward on the seat with the back pressed against the back rest and the feet resting on the surface on which the apparatus is supported . The arms are disposed in a generally horizontal position on the arm rests and the fingers may engage the hand grips. Adjustments may be made to the seat height and hand grips, if desired or needed, so that the user assumes a comfortable position.

To initiate exercise along the first axis, the users exerts a rearward force on the backrest keeping the arms flat on the arm rests. In this motion, the resistance of the machine counteracts the back exertion and the back muscles are exercised, so that the apparatus assumes the position shown in FIG. 5. The user then pulls forward with the stomach muscles to rotate the arm rests forward in a dipping forward rotation.

To initiate exercise along the second axis of rotation, the user may then lean to one side, applying unequal forces to the tops of the respective arm rests, causing the arm rest assembly to rotate about the second axis, so that the apparatus assumes the configuration shown in FIG. 4. The user then leans to the opposite side causing the apparatus to move to the opposite side position. In these motions, the resistance of the machine counteracts the user's exertions, thus exercising muscles along both sides of the torso.

For any of the aforementioned positions, the user may hold the position for an extended period in order to apply resistance to the muscles for the extended period.

Additionally, a user may exercise in a circular rolling motion. For example, the user may start in the right side position, but instead of returning to the centered position (where spring tension is minimal), the user swings in a circular motion to the front position, and continues the circular motion through the left side position and the back position. Without stopping, this circular motion may be repeated. This exercise permits exercising muscles in the back, front and side midsection in one continuous movement.

It will be appreciated the user may alternate the various exercises in a single workout session without adjusting the apparatus or reorienting himself with respect to the apparatus.

Figure 8:
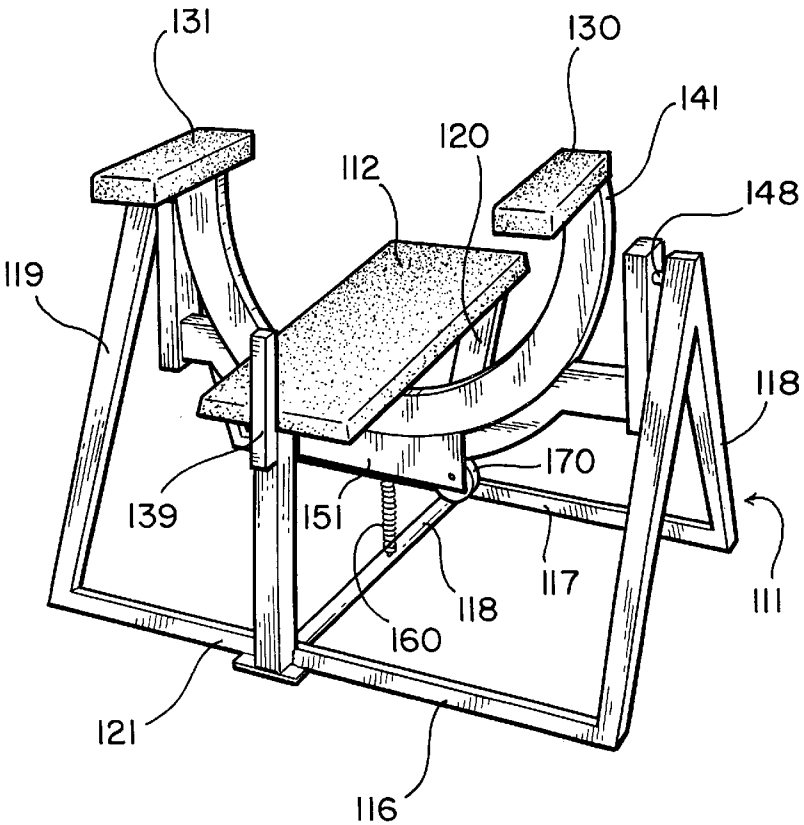
FIG. 8 is a back perspective view of an alternate embodiment of an exercise apparatus.

FIG. 8 illustrates an alternate configuration. An arm rest assembly includes arm rests 130, 131 connected with an arm rest bracket 140 extending below the seat 112, the arm rest assembly being pivotally connected to stationary frame 111. In the illustrated embodiment, frame 111 has the form of two parallel A-frames 118, 119 connected by lower bars 115, 116 and 117 that support the apparatus on a support surface, and the stationary seat 112 is also attached to the frame through uprights 120, 121. A post 139 may be provided on upright 121 for mounting of a back rest, in which case the back rest does not move in conjunction with the arm rest assembly, or the back rest post and back rest may not be present. The arm rest bracket 140 is mounted to plate 151, and the bracket 140 is slidably mounted (for side-to-side motion of the arm rest assembly with respect to the frame) in a track bar 141, the track bar 141 connected to the frame A-frames 118, 119 by side mounted concentric bearings 148 (for front-to-back motion of the arm rest assembly with respect to the frame). Plate 151 is fixedly attached to bracket 140, and plate 151 slides with respect to track bar 141 during the side-to-side motion via roller system 170. Resistance is provided by a spring 161 linking the pulley assembly to the frame, with additional resistance during the side-to-side motion being provided by the gliding of bracket 140 with respect to bar 141. This configuration provides substantially universal type motion with both axes of rotation on generally the same virtual point. It is contemplated that different radii of motion may be employed to provide a different exercise configuration. In addition, the track system may employ non-circular motion profiles for a desired side-to-side exercise.

Other configurations of a universal coupling between the arm rest assembly and the frame are possible, for example, a ball-and-socket joint.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

I claim:

1. An exercise apparatus, comprising:

(a) a stationary frame;

(b) a seat connected to the frame top preclude rotation relative to the frame; and (c) a pair of arm rests pivotally connected to the frame for front-to back rocking motion about a first horizontal axis and side-to-side rocking motion about a second horizontal axis with respect to the frame, the first and the second axis being located intermediate the seat and the arm rests and orthogonally disposed to provide a universal pivot point that generally coincides with a point just below the sternum of a user's body.

2. The exercise apparatus of claim 1, wherein the arm rests are connected to one another through an arm rest bracket.

3. The exercise apparatus of claim 2, wherein the arm rests are disposed above the seat.

4. The exercise apparatus of claim 3, wherein the arm rest bracket is in the shape of a circular arc and extends between the arm rests and below the seat.

5. The exercise apparatus of claim 1, wherein the seat remains stationary with respect to the frame during the motion of the arm rests.

6. The exercise apparatus of claim 5, wherein the seat is adjustable to a variety of positions relative to the frame.

7. The exercise apparatus of claim 1, further comprising a back rest disposed above the seat.

8. The exercise apparatus of claim 7, wherein the back rest is mounted to a rear bracket extending between the arm rests, and the back rest pivots in conjunction with the arm rests with respect to the frame.

9. The exercise apparatus of claim 8, wherein the arm rests are also connected to one another through an arm rest bracket extending between the arm rests and below the seat, the arm rest bracket being in the shape of a circular arc.

10. The exercise apparatus of claim 1, wherein the first axis and the second axis are orthogonally disposed.

11. The exercise apparatus of claim 1, wherein tension of the spring is adjustable to vary resistance of the pivotal motion of the arm rest with respect to the frame.

12. The exercise apparatus of claim 11, wherein the spring comprises elastics straps.

13. The exercise apparatus of claim 1, wherein the first axis is aligned with a longitudinal axis of the seat, and the second axis is perpendicular to the first axis.

14. The exercise apparatus of claim 1, further comprising hand grips adjacent the arm rests.

15. The exercise apparatus of claim 14, wherein the hands grips are adjustable with respect to the arm rests.

16. The exercise apparatus of claim 1, wherein an arm rest assembly including the pair of arm rests is movable with respect to the frame in a rocking motion along the first axis, and in a rocking motion along the second axis.

17. The exercise apparatus of claim 16, wherein the arm rest assembly is also movable with respect to the frame along an accurate path.

18. An exercise apparatus, comprising:

(a) a frame;

(b) a seat non rotatably connected to the frame and lying generally in a plane;

(c) a backrest attached to the frame by a rotational connection having a horizontal axis of rotation generally parallel to the plane and spaced therefrom to permit side-to-side rocking motion of the backrest relative to the frame; and (d) a pair of arm rests attached to the frame by a pivotal connection having a pivot axis spaced from and generally parallel to the plane, and generally perpendicular to the rotational connection to permit front-to-back rocking motion of the arm rests relative to the frame.

19. The exercise apparatus of claim 18, wherein the rotational connection includes a section of generally circular track attached to the backrest and a plurality of rollers supporting the track.

20. The exercise apparatus of claim 18, wherein the pivotal connection includes a pair of stub axles attached to the backrest and journaled in a pair of bearings.

* * * * *